US012297831B1

(12) United States Patent
Shaw

(10) Patent No.: US 12,297,831 B1
(45) Date of Patent: May 13, 2025

(54) PARALLEL CONNECTED MULTIPLE SHAFT ROOTS VACUUM PUMP

(71) Applicants: ELIVAC CO., LTD., Shanghai (CN); China Link Consultant Company, Ltd, Shanghai (CN)

(72) Inventor: Raymond Zhou Shaw, Shanghai (CN)

(73) Assignees: ELIVAC CO., LTD, Shanghai (CN); China Link Consultant Company Ltd, Shanghai (CN)

( * ) Notice: Subject to any disclaimer, the term of this patent is extended or adjusted under 35 U.S.C. 154(b) by 0 days.

(21) Appl. No.: 18/386,254

(22) Filed: Nov. 2, 2023

(51) Int. Cl.

| | |
|---|---|
| ***F04C 18/12*** | (2006.01) |
| ***F04C 18/18*** | (2006.01) |
| ***F04C 23/00*** | (2006.01) |
| ***F04C 25/02*** | (2006.01) |
| ***F04C 27/00*** | (2006.01) |
| ***F04C 29/00*** | (2006.01) |
| ***F04C 29/02*** | (2006.01) |
| ***F04C 29/04*** | (2006.01) |

(52) U.S. Cl.
CPC ..... *F04C 18/126* (2013.01); *F04C 18/18* (2013.01); *F04C 23/001* (2013.01); *F04C 23/003* (2013.01); *F04C 25/02* (2013.01); *F04C 27/009* (2013.01); *F04C 29/0071* (2013.01); *F04C 29/02* (2013.01); *F04C 29/04* (2013.01); *F04C 2240/20* (2013.01); *F04C 2240/30* (2013.01); *F04C 2240/50* (2013.01); *F04C 2250/10* (2013.01); *F04C 2250/101* (2013.01); *F04C 2250/102* (2013.01); *F04C 2250/20* (2013.01); *F04C 2250/30* (2013.01)

(58) Field of Classification Search
CPC ..... F04C 18/126; F04C 18/18; F04C 23/001; F04C 23/003; F04C 25/02; F04C 27/009; F04C 29/0071; F04C 29/02; F04C 29/04; F04C 2240/20; F04C 2240/30; F04C 2240/50; F04C 2250/10; F04C 2250/101; F04C 2250/102; F04C 2250/20; F04C 2250/30
See application file for complete search history.

(56) References Cited

FOREIGN PATENT DOCUMENTS

| | | | |
|---|---|---|---|
| CN | 201636008 U | * | 11/2010 |
| EP | 0953771 A1 | * | 11/1999 |
| JP | H11247782 A | * | 9/1999 |

* cited by examiner

*Primary Examiner* — Mary A Davis

(57) ABSTRACT

A parallel connected multiple shaft roots vacuum pump includes an electric motor (30); a pump body which has N (N is an integers and is greater or equal to 2) parallel pump chambers (11); a bladed rotor set (4) installed within the pump body and including an active bladed rotor (3), and 2N-1 driven bladed rotors (41, 42, 43); wherein the active bladed rotor includes an active driving gear (8); each driven bladed rotor includes a respective driven gear (401, 402, 403) which are installed at two sides of the active driving gear; a bridge gear set (9) is installed between the active driving gear (8) and two driven gears (402, 403) at a right side of the active driving gear.

10 Claims, 9 Drawing Sheets

PARALLEL CONNECTED MULTIPLE SHAFT ROOTS VACUUM PUMP

FIELD OF THE INVENTION

The present invention is related to roots pumps, and in particular to a parallel connected multiple shaft roots vacuum pump.

BACKGROUND OF THE INVENTION

Roots vacuum pumps are rotational volume changeable vacuum pump without internal compression, which has the advantages of large pumping volume, low power consumption rate, steady operation, etc. It is used widely in many industrial fields.

Current roots vacuum pumps has a two shaft design. One active shaft drives one driving shaft with low compression ratio. As a result, the pumping efficiency is low. Currently, there are three-shaft roots vacuum pumps, which serially connect several chambers. Each chamber has three shaft each of which is formed with blades. Air flows into a first pump chamber and out of a last pump chamber. This kind of three shaft roots pump, as comparing with a single shaft roots pump, has higher pumping speed and higher vacuum ratio. However, since there are several chambers which are serially connected, more parts are needed and installation work is complicated. The heat expansion of the shafts is great since each shaft is long. The accumulation errors are high. As a result, the engagement of the rotors internally is bad so that collisions of the parts occurs and the steadiness of the products are low.

The present invention is aimed to resolve the above mentioned defects in the prior art.

SUMMARY OF THE INVENTION

Accordingly, the object of the present invention is to provide a parallel connected multiple shaft roots vacuum pump, wherein in the present invention, the electric motor serves to drive the shaft of the active blade rotor 3. N-1 bridge gear set is used to transfer power from the active blade rotor to other driven blade motor so that all the blade rotors rotates synchronously. The roots vacuum pump of the present invention, as comparing other prior art vacuum pump, has the advantages of large pump ability, high volume, lower power consumption, dust-proof, convenience in maintenance, long lifetime, and others. The present invention has a compact structure, equilibrium in power distribution, steadiness in operation, and others. The design of the present invention can be extended to design of screw rod type vacuum pump.

Two achieve objects, the present invention provides a parallel connected multiple shaft roots vacuum pump, which includes an electric motor (30); a pump body which has N (N is an integers and is greater or equal to 2) parallel pump chambers (11); a bladed rotor set (4) installed within the pump body and including an active bladed rotor (3), and 2N-1 driven bladed rotors (41, 42, 43); wherein the active bladed rotor includes an active driving gear (8); each driven bladed rotor includes a respective driven gear (401, 402, 403) which are installed at two sides of the active driving gear; a bridge gear set (9) is installed between the active driving gear (8) and two driven gears (402, 403) at a right side of the active driving gear, In one application, N is equal to 2; the parallel connected multiple shaft roots vacuum pump includes the electric motor, a pump body (1) with the two chambers (11), the active bladed rotor (3), the three driven bladed rotors and a driving gear set (20); the active bladed rotor (8) has one end connected to the electric motor (30) through a shaft connector (32) and another thereof is connected to an active driving gear (8); the three driven bladed rotors includes: a left driven bladed rotor (41) at a left side of the active bladed rotor (3); the left driven bladed rotor is connected to a left driven gear (401) which is then engaged with the active driving gear (8) so that the active bladed rotor drives the left driven bladed rotor;

two right driven bladed rotors (42, 43) each of which are connected to respective right driven gears (402, 403); one right driven gear (402) is engaged with another right driven gear (403); the pump body includes the two chambers (11) which are arranged in parallel; each chamber receives two bladed rotors. the pump body has a hollow enclosure (101) of elliptical cross sections; two sides of the body are covered by a rear cover (102) and a front cover (103); each of the rear cover and the front cover has several openings for passing shafts of rotor sets; the active driving gear (8) is engaged directly with the left driven gear (401); the active driving gear is engaged with one side of the bridge gear set (9); and another side of the bridge gear set is engaged with one of the right driven gears; the two right driven gears (402, 403) are engaged with each other; and thus the active driving gear drives the right driven gear and the two left driving gear, and thus the active bladed rotor can drive the left bladed rotor and the right bladed rotor; all the gears forms as a driving gear set (20).

DETAILED DESCRIPTION OF THE INVENTION

Figure 1:
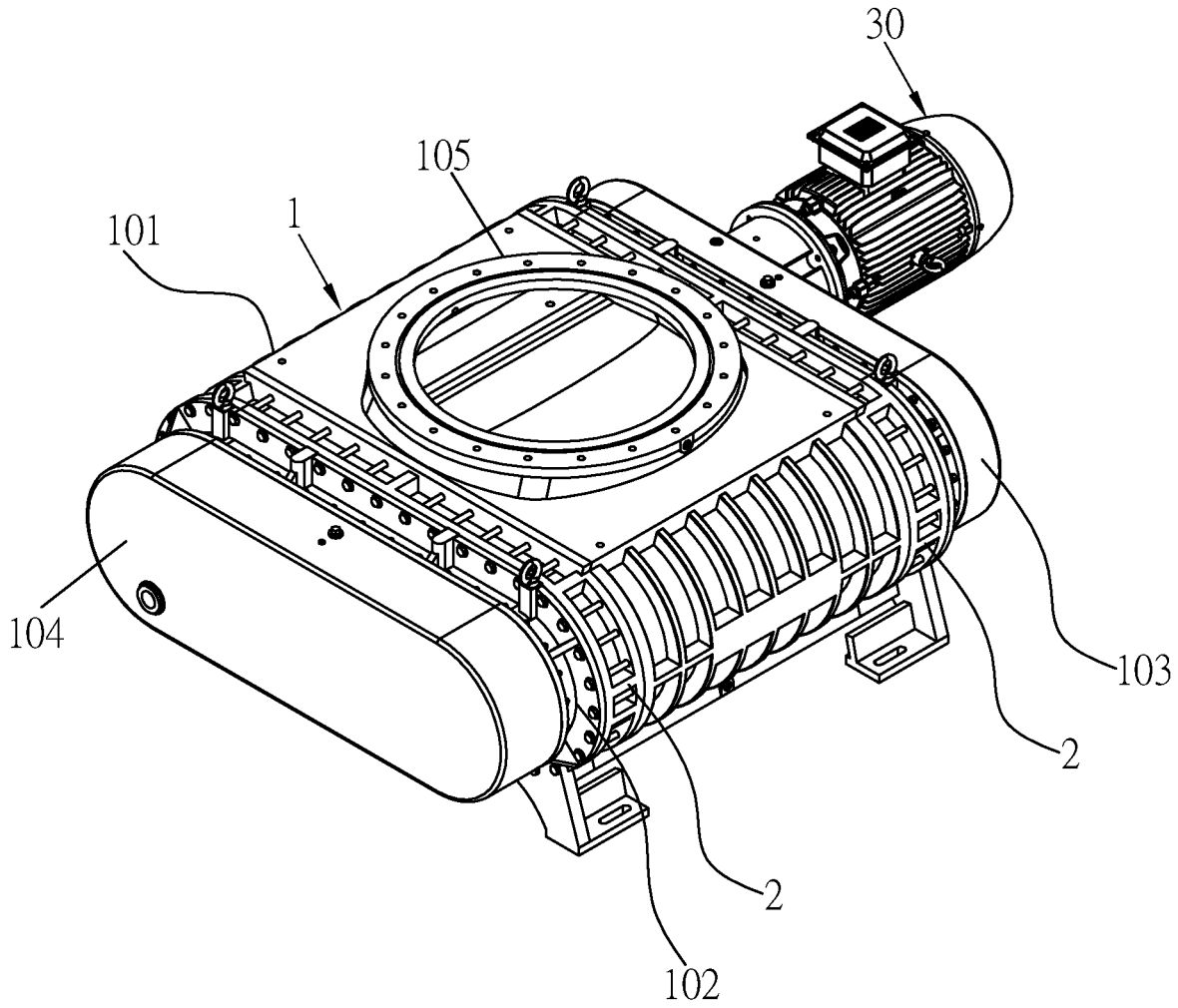
FIG. 1 shows the structure of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 9, the parallel multiple shaft roots vacuum pump according to the present invention is illustrated as stated in the following.

The parallel multiple shaft roots vacuum pump of the present invention includes a body 1 which has N (N is an integers and is greater or equal to 2) parallel pump chambers 11. A bladed rotor set 4 within the body 1 includes an active bladed rotor 3, and 2N-1 driven bladed rotors. The active bladed rotor 3 includes an active driving gear 8. Each driven bladed rotor includes a respective driven gear 401, 402, 403 which are installed at two sides of the active driving gear 8. A bridge gear set 9 is installed between the active driving gear 8 and two driven gears 402, 403 at a right side of the active driving gear 8, In the following description, an example of N=2 is used. At this example, the parallel connected multiple shaft roots vacuum pump includes an electric motor 30, a pump body 1 with two chambers, an active bladed rotor 3, three driven bladed rotors, and a driving gear set 20. In the following, the detail structure of this application will be described.

An electric motor 30 serves for driving a parallel four-shaft roots vacuum pump. The electric motor 30 is driven with fixed or varied frequencies.

Figure 2:
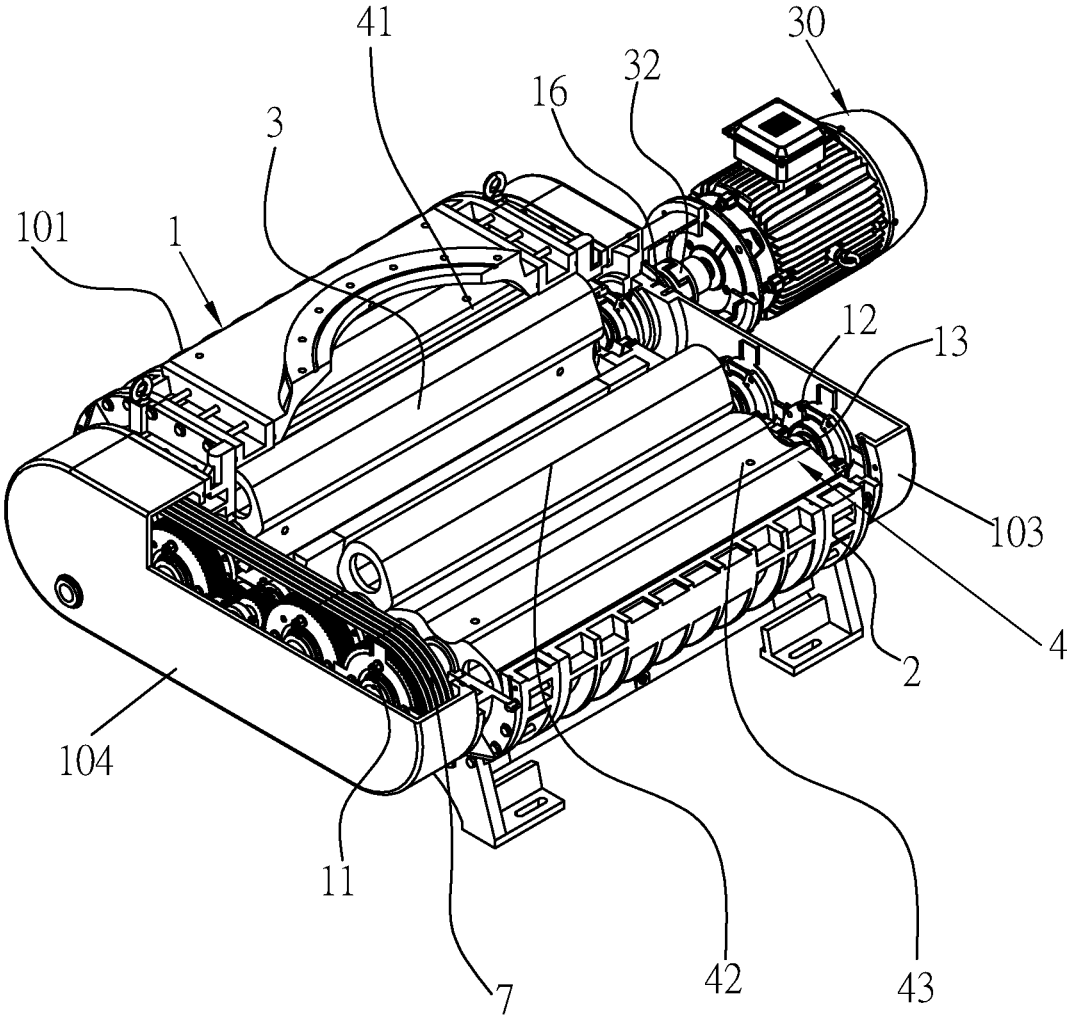
FIG. 2 is a structure view showing some parts of the present invention.
Figure 9:
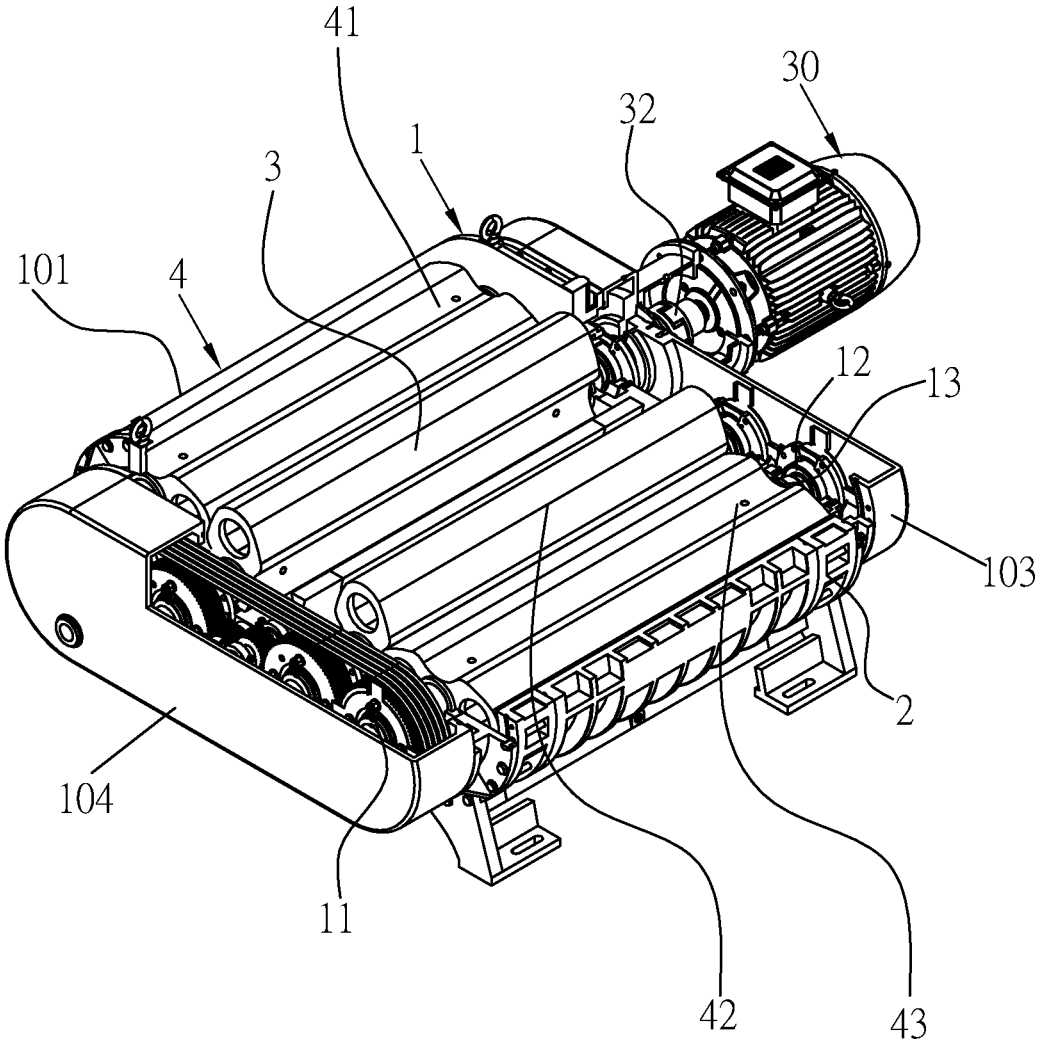
FIG. 9 is a structure view showing the interior of the present invention.

As illustrated in FIGS. 2 and 9, it is illustrated the bladed rotor set 4 includes the following elements.

An active bladed rotor 3 has one end connected to the electric motor 30 through a shaft connector 32 and another thereof is connected to an active driving gear 8.

The three driven bladed rotors includes:

A left driven bladed rotor 41 is at a left side of the active bladed rotor 3. The left driven bladed rotor 41 is connected to a left driven gear 401 which is then engaged with the active driving gear 8 so that the active bladed rotor 3 drives the left driven bladed rotor 41.

Two right driven bladed rotors 42, 43 each of which are connected to respective right driven gears 402, 403. The right driven gear 402 is engaged with another right driven gear 403.

Figure 7:
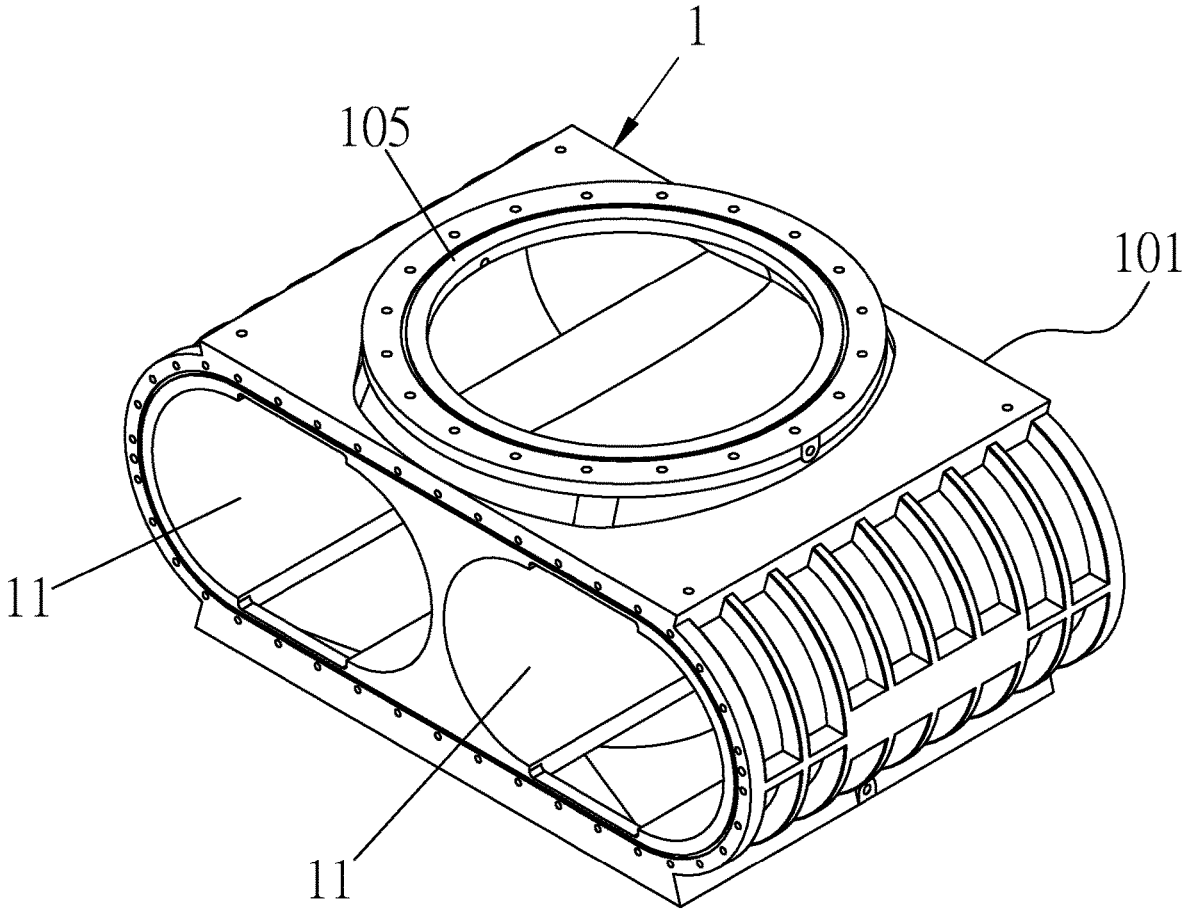
FIG. 7 shows the structure of the pump of the present invention.
Figure 8:
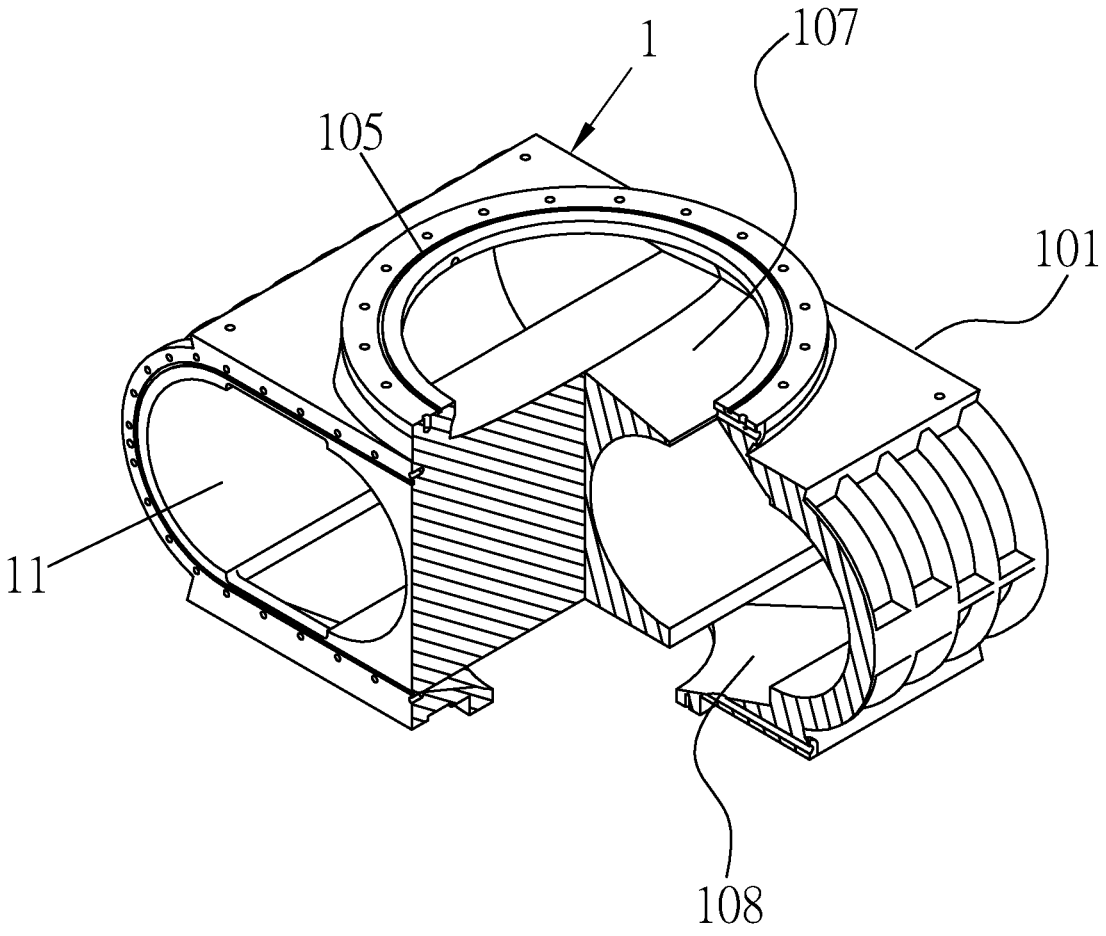
FIG. 8 is a partial cross section view of the pump body of the present invention.

A two chamber body 1 serves to receive the rotor set 4. The two chamber body 1 includes two chambers 11, as illustrated in FIGS. 7 and 8. The two chambers 11 are arranged in parallel. Each chamber 11 receives two bladed rotors. The body 1 has a hollow enclosure 101 with elliptical cross sections. Two sides of the body 1 are covered by a rear cover 102 and a front cover 103. Each of the rear cover 102 and the front cover 103 has several openings for passing shafts of rotor sets 4.

Therefore, the enclosure 101, the rear cover 103 and the front cover 103 are formed as a sealed space for receiving the rotor set 4. In use, the two chamber body 1 is arranged flatly with the bladed rotors therein which are arranged as a shape of "OCCO" The two chambers 11 may be integrally formed, or the two chambers 11 separately formed and then they are combined by positioning pins, O rings, or studs, and they are spaced with a finite distance. Referring to FIG. 7, FIG. 7 shows that the two chambers are arranged in parallel, however, this structure is not used to confine the scope of the present invention. There are several chambers which are arranged in parallel.

In application of the present invention, each end side of the two chamber body 1 is connected with a connection ring 2 for connecting to the rear cover 102 and the front cover 103 and for enlarging the receiving space of the two chamber body 1.

Figure 5:
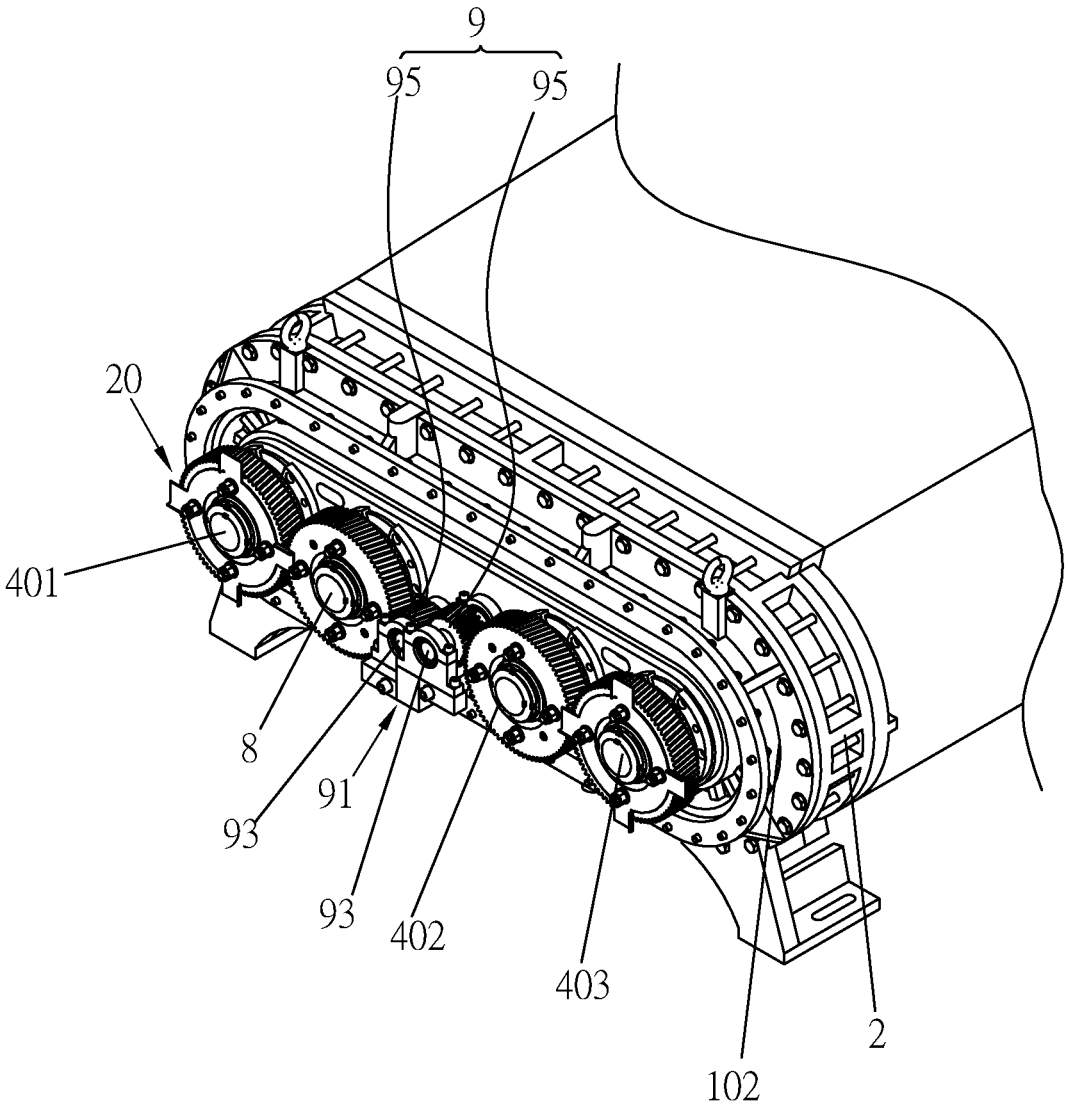
FIG. 5 is a structure view showing the gear connection of the present invention.

The bridge gear set 9 includes two bridge gears 95 (referring to FIG. 5). Thereby, a motor can drive several bladed rotors. The active bladed rotor 3 and the left driven bladed rotor 41 are arranged as an air suction unit. The active driving gear 8 is engaged with the left driven gear 401 directly. In application, two right bladed rotors 42, 43 are arranged as another air suction unit. The active driving gear 8, the left driven gear 401, and the two right driven gears 402, 403, and the bridge gear set 9 are arranged as a driving gear set 20.

The side having the rear cover 102 is formed as a gear lubricating oil box 104 for receiving the driving gear set 20. Shafts of the bladed rotor set 4 passes through holes in the rear cover 102 to be connected with the driving gear set 20. The active driving gear 8 is engaged with one side of the bridge gear set 9, and another side of the bridge gear set 9 is engaged with one of the right driven gear 402 which is further engaged with another right driven gear 403. Therefore, the active driving gear 8 can drive the two right driven gears 402, and 403 through the bridge gear set.

The active driving gear 8, the left driven gear 401 and the two right driven gears 402, 403 have same numbers of teeth (Z1=79) and mode numbers (M=3.5). The speed ratio of the bridge gear set 95 is 1. Number of teeth of the bridge gear set 9 is 28, and the mode number of the bridge gear set 9 is 3.5. They all have the same mode number. Therefore, one motor can drive several bladed rotors to rotate. The rotors in one chamber have opposite rotation direction, and thus it has the effect of vacuuming.

Figure 3:
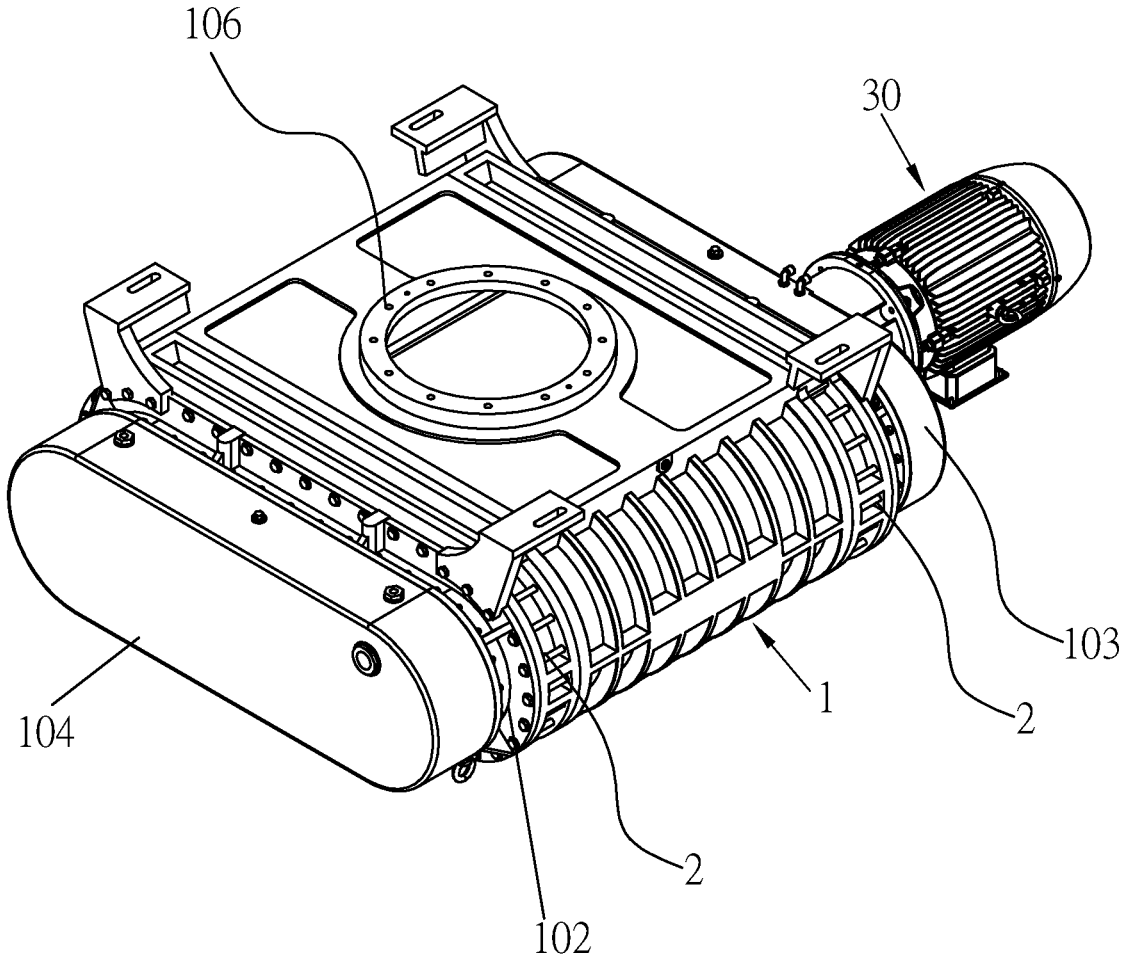
FIG. 3 is a bottom side view of the present invention.
Figure 4:
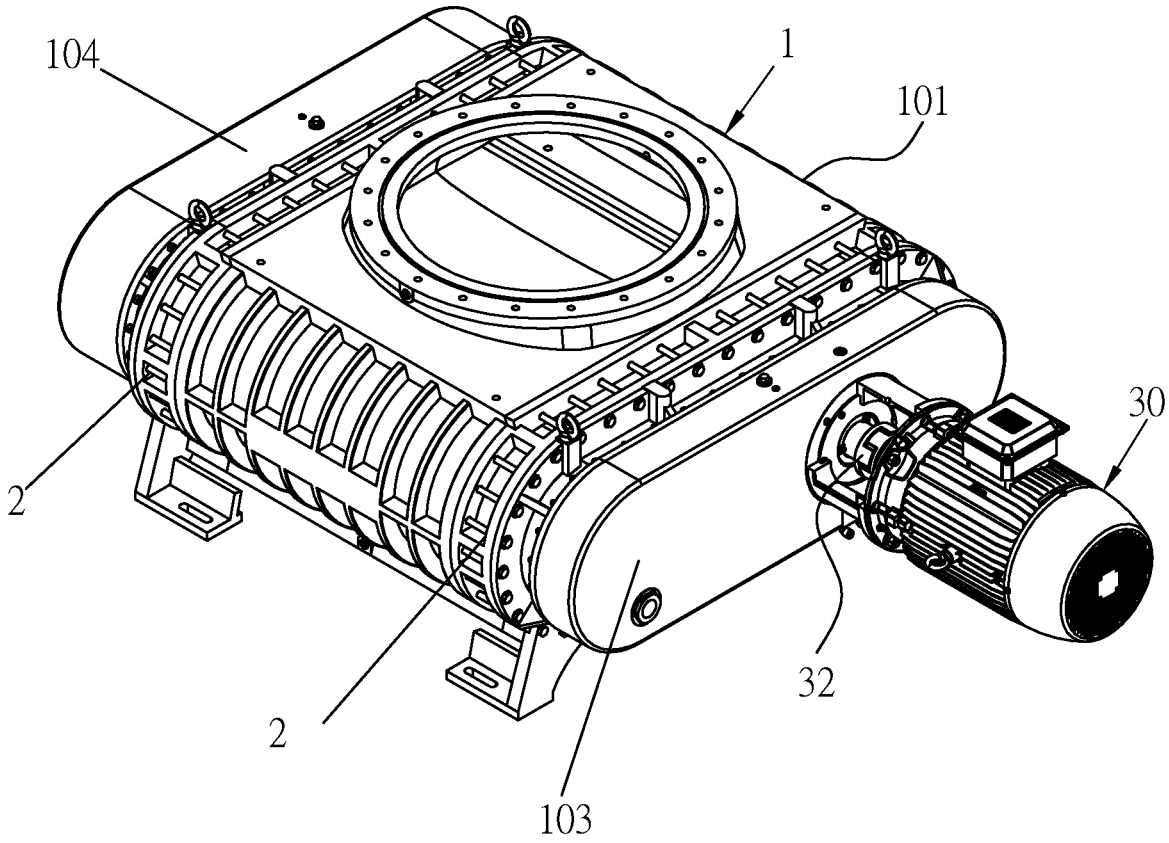
FIG. 4 is a front view of the present invention.

Referring to FIGS. 1, 3, and 8, the body 1 has only one air inlet 105 and one air outlet 106 which are co-used for the body 1. The inlet 105 is at a center portion of an upper side of the enclosure 101 and the outlet 106 is at a center portion of a lower side of the enclosure 106. Air entering into the inlet 105 is then separated into two flows by two inclined paths 107 at an upper side of the body 1 and then enters into a suction space at an upper space of the body 1 and then are compressed to be drained out through two lower inclined paths 108 at a lower portion of the body 1.

Figure 6:
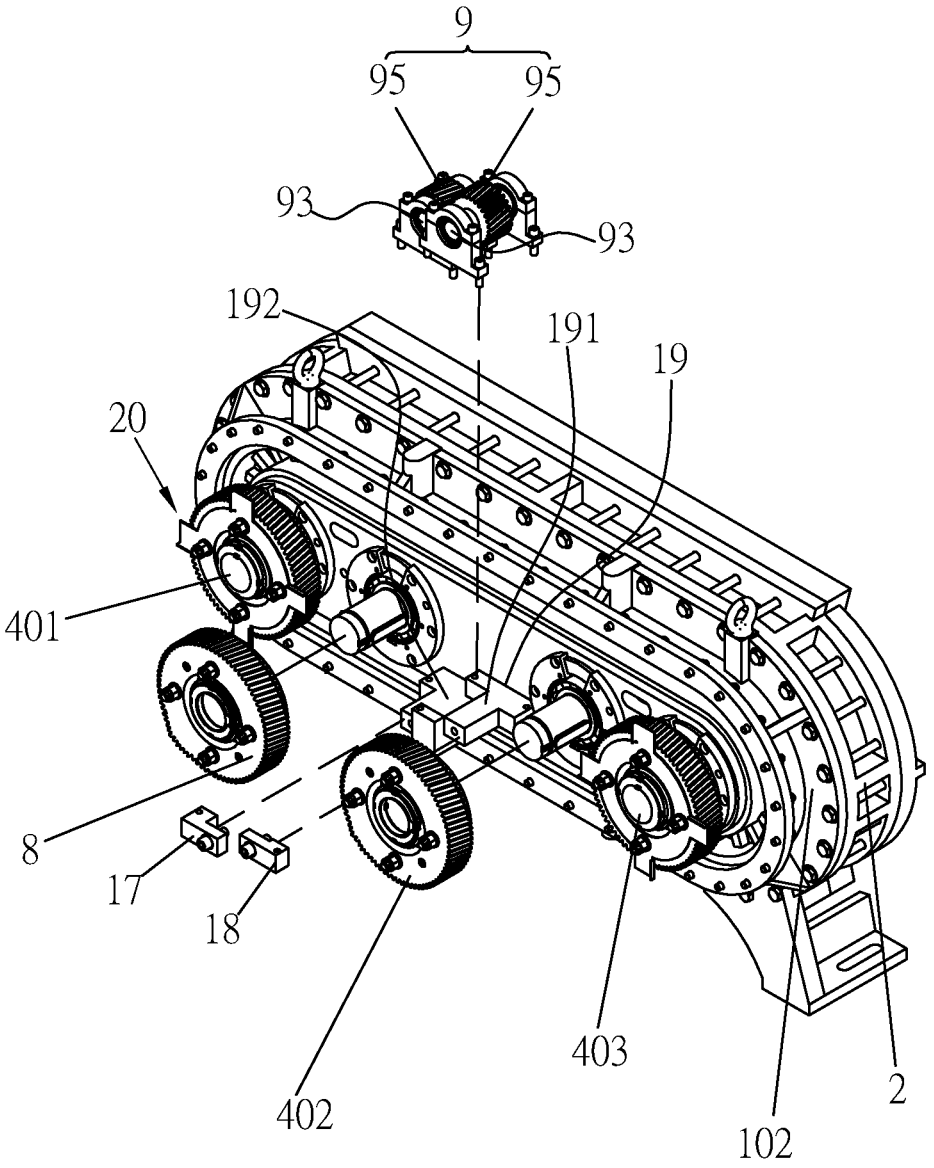
FIG. 6 is a schematic view showing the connection of the gears of the present invention.

Referring to FIGS. 5 and 6, the bridge gear set 9 is installed on a gear supporting frame 91 which is installed on the rear cover 102 near the gear lubricating oil box 104. The gear supporting frame 91 is formed by a supporting plate 19, a first supporting block 17 and a second supporting block 18.

The supporting plate 19 is integrally formed with the rear cover 102, and has a Z shape with two stepped supporting surfaces 191, 192 which have a level distance of 39 mm. The first supporting block 17 and the second supporting block 18 are locked to the two stepped supporting surfaces 191, 192, respectively so as to form a complete gear supporting frame 91.

Each of the supporting surfaces 191, 192 has a notch at an outer lateral side thereof for preventing that the gear supporting plate 19 to collide the adjacent bladed rotor gears. The first and second supporting blocks 17, 18 serve to prevent that bladed rotor gears adjacent to the bridge gear set 9 to collide the gear supporting frame 91.

The bridge gear set 9 includes two bridge shafts 93 which are connected to respective bridge gears 95. The first and second bridge gears 95, 95 are engaged with each other. The two bridge shafts 93 are connected to the holes on the supporting frame 91.

Referring to FIG. 2, front ends of the four shafts of the bladed rotor set 4 are fixed to the front cover 103 through ball bearings 12 and rear ends thereof are fixed to the rear cover 102 through bearings 11.

The four shaft bladed rotor set can have shorter length then three shaft multi-stage roots vacuum pump and thus heat stress and expansion are also smaller so that blades of the rotors do not deadly buckled in the enclosure.

Referring to FIG. 2, all the bearings of the bladed rotor set 4 are sealed by 130/100/12 ceramic sealing (13) for preventing the lubricating oil from returning to the chamber 11 so destroy the vacuum. The ceramic sealing has the advantages of wearing proof and softness as rubber edges. These softness as rubber edge can assure that small air in the bearing space flows into the chamber 11 when the pressure in the bearing space is too high so that pressure in the bearing space is balanced with that of the chamber 11. When the pressure is balanced, effect of sealing is achieved so as to prolong the lifetime of the ceramic sealing to avoid lubricating oil returning to the pump chamber 11.

In the present invention, the active bladed rotor 3 uses 75 #concentration vacuum sealing (16) to avoid air flowing into the pump body. In the gear lubricating oil box 104 is installed with a plurality of cooling tubes 7 for cooling the box 104. The rear cover 104 is formed with sheet like water box (not shown) for temperature reduction of the root pump.

In the present invention, the electric motor serves to drive the shaft of the active blade rotor 3. N-1 bridge gear set is used to transfer power from the active blade rotor to other driven blade motor so that all the blade rotors rotates synchronously. The roots vacuum pump of the present invention, as comparing other prior art vacuum pump, has the advantages of large pump ability, high volume, lower power consumption, dust-proof, convenience in maintenance, long lifetime, and others. The present invention has a compact structure, equilibrium in power distribution, steadiness in operation, and others. The design of the present invention can be extended to design of screw rod type vacuum pump.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

a

What is claimed is:

1. A parallel connected multiple shaft roots vacuum pump, comprising:

an electric motor (30);

a pump body which has N parallel pump chambers (11); wherein N is an integers and is greater or equal to 2;

a bladed rotor set (4) installed within the pump body and including an active bladed rotor (3), and 2N-1 driven bladed rotors (41, 42, 43);

wherein the active bladed rotor includes an active driving gear (8); each driven bladed rotor includes a respective driven gear (401, 402, 403) which are installed at two sides of the active driving gear; a bridge gear set (9) is installed between the active driving gear (8) and two driven gears (402, 403) at a right side of the active driving gear.

2. The parallel connected multiple shaft roots vacuum pump as claimed in claim 1, wherein N is equal to 2; the parallel connected multiple shaft roots vacuum pump includes the electric motor, a pump body (1) with the two parallel pump chambers (11), the active bladed rotor (3), the three driven bladed rotors and a driving gear set (20);

the active bladed rotor (8) (3) has one end connected to the electric motor (30) through a shaft connector (32) and another thereof one end of the active bladed rotor (3) is connected to an active driving gear (8);

the three driven bladed rotors includes:

a left driven bladed rotor (41) at a left side of the active bladed rotor (3); the left driven bladed rotor is connected to a left driven gear (401) which is then engaged with the active driving gear (8) so that the active bladed rotor drives the left driven bladed rotor;

two right driven bladed rotors (42, 43) each of which are connected to respective right driven gears (402, 403); one right driven gear (402) is engaged with another right driven gear (403);

the pump body includes the parallel pump chambers (11) which are arranged in parallel; each chamber receives two bladed rotors-; the pump body has a hollow enclosure (101) of elliptical cross sections; two sides of the pump body are covered by a rear cover (102) and a front cover (103); each of the rear cover and the front cover has several openings for passing shafts of rotor sets;

the active driving gear (8) is engaged directly with the left driven gear (401); the active driving gear is engaged with one side of the bridge gear set (9); and another side of the bridge gear set is engaged with one of the right driven gears; the two right driven gears (402, 403) are engaged with each other; and thus the active driving gear drives the right driven gear and the two left driving gear, and thus the active bladed rotor can drive the left bladed rotor and the right bladed rotor; all the gears forms as a driving gear set (20).

3. The parallel connected multiple shaft roots vacuum pump as claimed in claim 2, wherein the pump body (1) has only one air inlet and one air outlet which are used for the pump body; the inlet (105) is at a center portion of an upper side of the hollow enclosure (101) and the outlet (106) is at a center portion of a lower side of the hollow enclosure; air entering into the inlet is then separated into two flows by two inclined paths (107) at an upper side of the pump body and then enters into a suction space at an upper space of the pump body and then are compressed to be drained out through two lower inclined paths (108) at a lower portion of the pump body.

4. The parallel connected multiple shaft roots vacuum pump as claimed in claim 2, wherein a gear lubricating oil box (104) is formed at one side of the rear cover for receiving the driving gear set (20); shafts of the bladed rotor set (4) passes through holes in the rear cover to be connected with the driving gear set (20).

5. The parallel connected multiple shaft roots vacuum pump as claimed in claim 4, wherein the bridge gear set (9) have two bridge gears (95) which are installed on a gear supporting frame (91); the gear supporting frame is installed on the rear cover near the gear lubricating oil box (104); the gear supporting frame (91) is formed by a supporting plate (19), a first supporting block (17) and a second supporting block (18); and the supporting plate is integrally formed with the rear cover, and is connected as a Z shape and has two stepped supporting surfaces (191, 192); the first supporting block (17) and the second supporting block (18) are locked to the two stepped supporting surfaces, respectively so as to form a complete gear supporting frame.

6. The parallel connected multiple shaft roots vacuum pump as claimed in claim 5, wherein each of the two stepped supporting surfaces (191, 192) has a notch at an outer lateral side thereof for preventing the gear supporting plate (19) from colliding with the active driving gear (8) and the adjacent driven gear of the two driven gears (402, 403).

7. The parallel connected multiple shaft roots vacuum pump as claimed in claim 5, wherein the bridge gear set includes two bridge shafts (93) which are connected to respective bridge gears (95); the two bridge gears comprise a first bridge gear and a second bridge gear; the first and second bridge gears are engaged each other; and the two bridge shafts are connected to the holes on the supporting frame.

8. The parallel connected multiple shaft roots vacuum pump as claimed in claim 4, wherein the gear lubricating oil box (104) is installed with a plurality of cooling tubes (7) for cooling the lubricating oil box from within; and each end side of the pump body (1) is connected with a connection ring (2) for connecting to the rear cover (102) and the front cover (103) so at to enlarge the receiving space of the parallel pump chambers.

9. The parallel connected multiple shaft roots vacuum pump as claimed in claim 2, wherein each bearings used to the bladed rotor set is sealed by ceramic sealing (13) for preventing the lubricating oil from returning to the parallel pump chambers (11).

10. The parallel connected multiple shaft roots vacuum pump as claimed in claim 2, wherein the active driven gear (8) and the left and right two right driven gears (401, 402, 403) have same numbers of teeth and mode numbers; the speed ratio of the bridge gear set is 1; the mode numbers of the bridge gear set, the active driving gear, the left and right driven gear are identical.

* * * * *